US006802156B2

(12) United States Patent
Sherrett et al.

(10) Patent No.: US 6,802,156 B2
(45) Date of Patent: Oct. 12, 2004

(54) HURRICANE RESISTANT WINDOW

(75) Inventors: Craig Sherrett, Pittsburgh, PA (US); James Cosharek, Rillton, PA (US); Chuck Wetmore, Pittsburgh, PA (US)

(73) Assignee: Kensington Windows Inc., Vandergrift, PA (US)

( * ) Notice: Subject to any disclaimer, the term of this patent is extended or adjusted under 35 U.S.C. 154(b) by 0 days.

(21) Appl. No.: 10/154,003

(22) Filed: May 23, 2002

(65) Prior Publication Data

US 2003/0217514 A1 Nov. 27, 2003

(51) Int. Cl.[7] ..... E05F 1/00; E05D 15/22
(52) U.S. Cl. ..... 49/445; 49/181; 52/204.5
(58) Field of Search ..... 49/445, 446, 181, 49/175, 447, 415, 417, 453; 16/197, 199, 198, 200; 52/204.5, 204.1, 204.7

(56) References Cited

U.S. PATENT DOCUMENTS

| | | | | |
|---|---|---|---|---|
| 4,763,445 A | | 8/1988 | Silverman | 49/176 |
| 5,014,466 A | | 5/1991 | Winner | 49/504 |
| 5,033,235 A | * | 7/1991 | Stark | 49/445 |
| 5,237,775 A | * | 8/1993 | Hardy | 49/181 |
| 5,383,303 A | * | 1/1995 | Nakanishi et al. | 49/181 |
| 5,546,702 A | | 8/1996 | deNormand et al. | 49/16 |
| 5,632,118 A | | 5/1997 | Stark | 49/181 |
| 5,918,419 A | * | 7/1999 | Cangialosi et al. | 49/194 |
| 5,934,031 A | | 8/1999 | deNormand | 52/204.5 |
| 6,006,478 A | | 12/1999 | Hübner et al. | 52/204.5 |

* cited by examiner

*Primary Examiner*—Hugh B. Thompson, II
(74) *Attorney, Agent, or Firm*—Webb Ziesenheim Logsdon Orkin & Hanson, P.C.

(57) ABSTRACT

A replacement window having a window frame, the window frame having a window header, a window sill, a first frame jamb, and a second frame jamb, wherein the first frame jamb and the second frame jamb each connect the window header to the window frame and the window header, the window sill, and the first frame jamb and the second frame jamb define a window frame opening. A sash having a reinforced sash header may be movably positioned in the window frame opening. A reinforcement pin may be positioned adjacent to the reinforced first sash header of the sash, and a jamb retainer clip may be positioned adjacent to the first jamb, the jamb retainer clip defining a reinforcement pin orifice, wherein the reinforcement pin orifice receives the reinforcement pin.

16 Claims, 8 Drawing Sheets

HURRICANE RESISTANT WINDOW

BACKGROUND OF THE INVENTION

1. Field of the Invention

The present invention relates to a replacement window, and more particularly, to a double-hung replacement window resistant to hurricane-force winds.

2. Description of the Prior Art

Most replacement windows sold in the United States are subjected to air infiltration, water infiltration, and structural integrity tests before being made commercially available. These three tests remain widely accepted throughout North America and performed on just about every window or door currently sold in the United States.

After Hurricane Andrew devastated Florida in August 1992, Dade and Broward counties enacted new window durability standards. As a result of the enacted standards, windows certified in Dade County are now subjected to a structural integrity test, a battery of missile impact tests, and a cyclical test.

To test structural integrity, a double-hung replacement window specimen is mounted on a wall and exterior surfaces of the window specimen is exposed to elevated air pressure. As described herein, a double-hung replacement window generally includes a window frame, a first sash, a second sash, a first insulated glass unit positioned in the first sash, and a second insulated glass unit positioned in the second sash. Exterior surfaces are generally those surfaces which are exposed to nature, while interior surfaces are generally those surfaces exposed to an interior room of a structure.

Water is then sprayed in and around the exterior window frame and sash surfaces of the double-hung replacement window specimen during the elevated air pressure exposure to simulate wind driven precipitation climate. The amount of air and water that penetrates through the double-hung replacement window specimen is then measured and recorded.

Next, three specimens of a double-hung replacement window are placed on another wall in preparation for a missile impact test. The missile impact test simulates the ability of the double-hung replacement window to prevent large objects from penetrating through the window frame, sashes, and insulated glass units. The missile impact test is facilitated by a pneumatic cannon placed a few feet away from the double-hung replacement window, wherein the pneumatic cannon is loaded with a 2"×4"×7' (approximate) piece of wood, or other object weighing nine pounds.

In specimen one, a piece of wood fired at the double-hung replacement window at approximately fifty feet per second, and impacts the meeting rail of the sashes, wherein the meeting rails are defined as an overlap region of the first sash and the second sash. Another piece of wood is then shot directly into a center portion of one of the insulated glass units.

In specimen two, a piece of wood impacts a center portion of one of the insulated glass units and another piece of wood impacts one of the insulated glass units approximately six inches away from one of the frame jamb. In specimen three, a piece of wood is fired at the meeting rail of the sashes and another piece of wood impacts one of the insulated glass units approximately six inches away from one of the frame jamb.

During the missile impact test, the insulated glass units can develop holes no larger than approximately five inches by one-sixteenth of an inch, but the pieces of wood cannot penetrate through the insulated glass units and into a simulated living area. If holes are formed in the insulated glass units, the holes can be covered with plastic prior to cyclical testing.

Finally, one or more of the battered and damaged double-hung replacement window specimens are then positioned in openings defined by one side of a hollow, box-shaped container. Each double-hung replacement window specimen is sealed in the opening to create an airtight seal. Air is then pumped into the hollow, box-shaped container, causing each specimen to bow or flex away from the container. The air is then evacuated, causing each specimen to bow inwardly toward the hollow portion of the box-shaped container. This cyclical test is repeated 9,000 times. If there is no failure, the double-hung replacement window passes certification.

Because the durability tests are quite rigorous, a need exists for a replacement window which will pass the strict testing discussed above.

SUMMARY OF THE PRESENT INVENTION

The present invention seeks to help provide a replacement window that will accommodate strict building codes. A replacement window according to the present invention generally includes a window frame having a window header, a window sill, a first frame jamb, and a second frame jamb, wherein the first frame jamb and the second frame jamb each connect the window header to the window frame, and the window header, the window sill, and the first frame jamb and the second frame jamb define a window frame opening.

At least one sash may be positioned in the window frame opening. One type of sash, such as a first sash, generally includes a first sash header, a first sash sill spaced away from the first sash header and oriented substantially parallel to the first sash header, a first sash jamb connected to one end of the first sash header and one end of the first sash sill, and a second sash jamb spaced away from the first sash jamb and is oriented substantially parallel to the first sash jamb and is connected to another end of the first sash header and another end of the first sash sill, wherein the first sash header, the first sash sill, the first sash jamb, and the second sash jamb define a first opening.

Another type of sash, such as a second sash preferably used in combination with the first sash in double-hung replacement window applications, is also movably positioned in the window frame opening. The second sash generally includes a reinforced, second sash header, a second sash sill spaced away from the second sash header and oriented substantially parallel to the second sash header, a third sash jamb connected to one end of the second sash header and one end of the second sash sill, and a fourth sash jamb spaced away from the third sash jamb and is oriented substantially parallel to the third sash jamb and is connected to another end of the second sash header and another end of the second sash sill. The second sash header, the second sash sill, the third sash jamb, and the fourth sash jamb define a second opening. Unlike the first sash, the second sash header of the second sash is reinforced with a reinforcement member preferably connected to or encased in the second sash header. The reinforcement member preferably has a hollow, double I-beam shape and is made from vinyl, metal, wood, or other suitable material. The reinforcement member may extend along an entire length of the second sash header or may be sectioned into two pieces. A reinforcement pin may be positioned adjacent to the second sash header of the second sash.

At least one jamb retainer clip may be positioned adjacent to the first frame jamb and another jamb retainer clip is preferably positioned adjacent to the second frame jamb. Each of the jamb retainer clips define a reinforcement pin orifice which receives a corresponding reinforcement pin, discussed above. The first frame jamb and the second frame jamb each also define a first balance track and a second balance track, and one jamb retainer clip may be positioned in the second balance track of the first frame jamb and another jamb retainer clip maybe positioned in the second balance track of the second frame jamb.

A plurality of shoe balances are also provided, wherein one of the plurality of shoe balances may be positioned in the first balance track defined by the first frame jamb, another one of the plurality of shoe balances may be positioned in the first balance track defined by the second frame jamb, another one of the plurality of shoe balances may be positioned in the second balance track defined by the first frame jamb, and another of the plurality of shoe balances may be positioned in the second balance track defined by the second frame jamb. The shoe balances slide in the balance tracks and are used to connect the sashes to the window frame.

These and other advantages of the present invention will be clarified in the description of the preferred embodiment taken together with the attached drawings in which like reference numerals represent like elements throughout.

DETAILED DESCRIPTION OF THE PREFERRED EMBODIMENT

Figure 1:
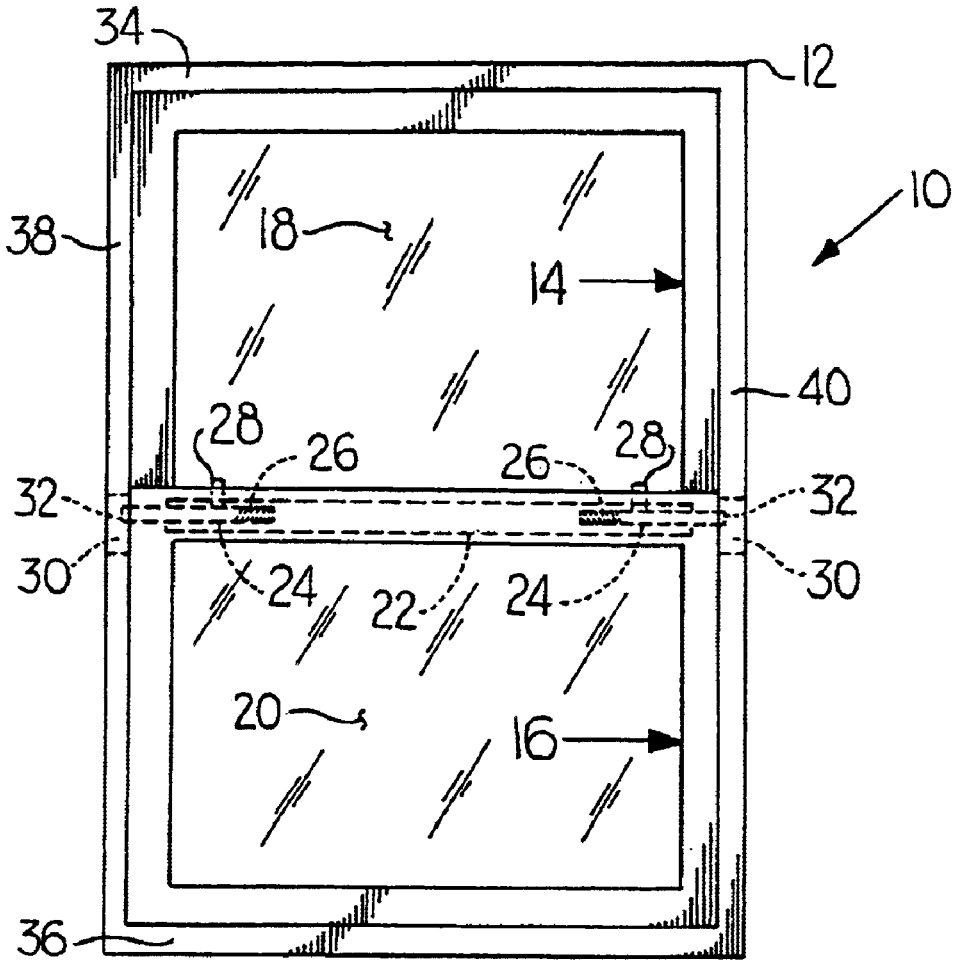
FIG. 1 is a plan view of an interior surface of a replacement window according to the present invention, with reinforcement elements shown in phantom.

The preferred embodiment of a replacement window 10 according to the present invention is generally shown in FIG. 1. The replacement window 10 includes a window frame 12, a first sash 14, a second sash 16, a first insulated glass unit 18, a second insulated glass unit 20, a reinforcement member 22, a reinforcement pin 24 preferably biased by a spring 26, a pin lever 28 connected to the reinforcement pin 24, and a jamb retainer clip 30 defining a reinforcement pin orifice 32. The reinforcement pin 24 is received in the reinforcement pin orifice 32 defined by the jamb retainer clip 30.

Figure 2:
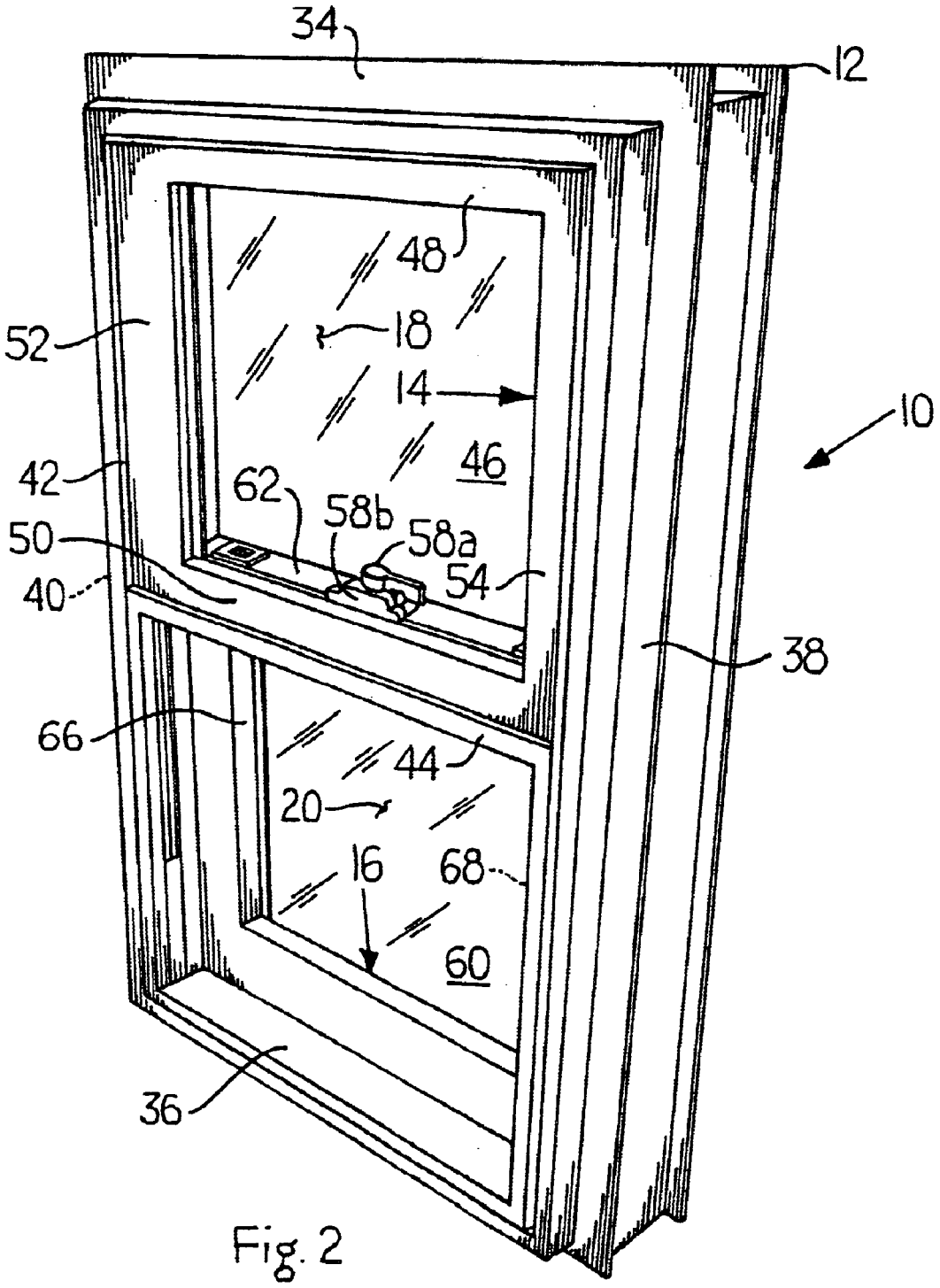
FIG. 2 is a perspective view of an exterior surface of the replacement window shown in FIG. 1.
Figure 3:
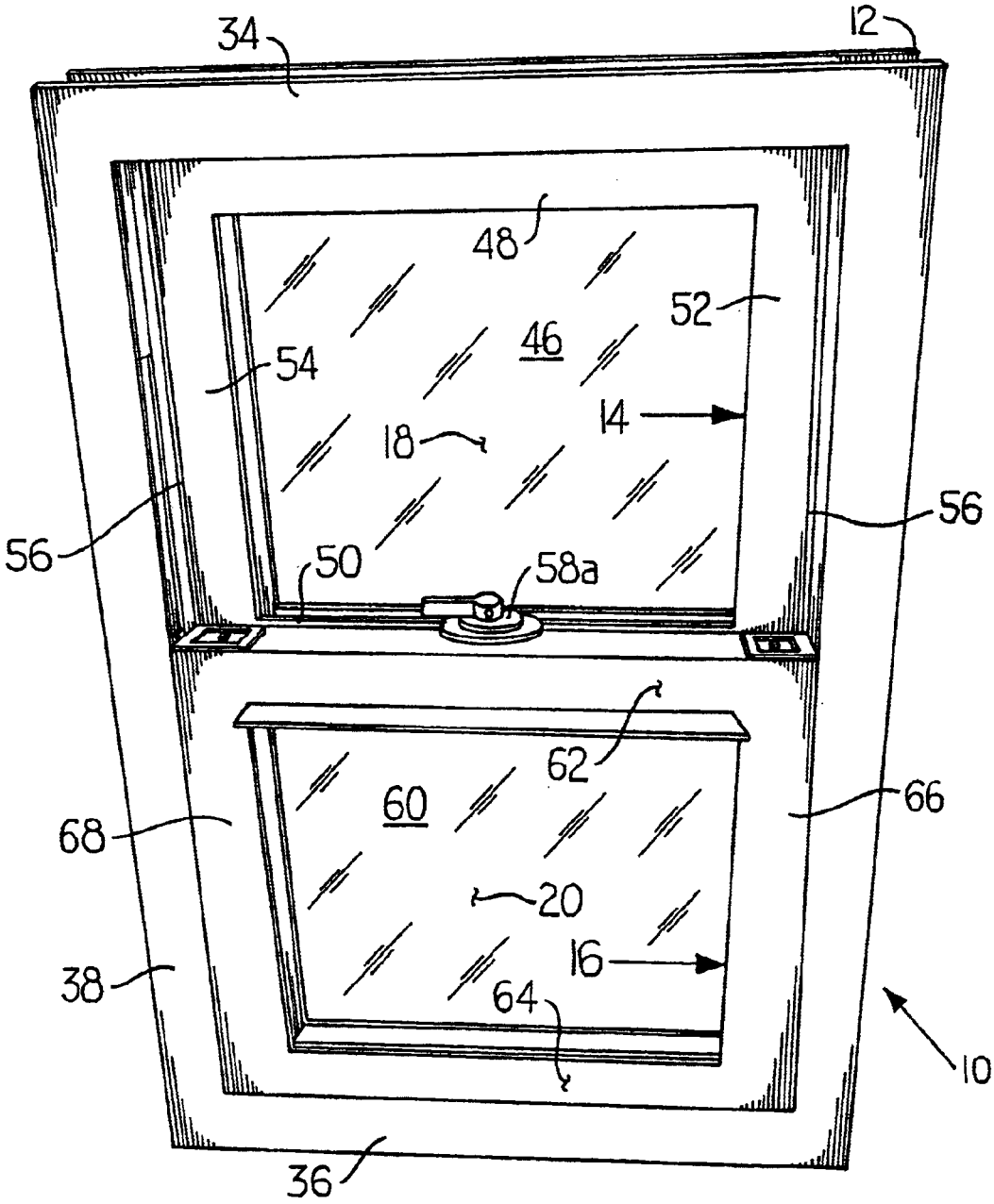
FIG. 3 is a perspective plan view of the interior surface of the replacement window shown in FIG. 2.

As shown generally in FIGS. 1–3, the window frame 12 generally includes a frame header 34, a frame sill 36 spaced away from the frame header 34 and oriented substantially parallel to the frame header 34, a first frame jamb 38 connected to another end of the frame header 34 and one end of the frame sill 36, and a second frame jamb 40 spaced away from the first frame jamb 38 and is oriented substantially parallel to the first frame jamb 38 and is connected to another end of the frame header 34 and the other end of the frame sill 36. As shown in FIG. 2, the frame header 34, frame sill 36, first frame jamb 38, and second frame jamb 40 may each further define a screen track 42 on an exterior portion of the window frame 12 for receiving a framed screen 44. The window frame 12 may be made from vinyl, wood, metal, plastic, fiberglass, or any other suitable material.

Referring again to FIGS. 1–3, the first sash 14 defines a first opening 46 formed by a first sash header 48, a first sash sill 50 spaced away from the first sash header 48 and oriented substantially parallel to the first sash header 48, a first sash jamb 52 connected to one end of the first sash header 48 and one end of the first sash sill 50, and a second sash jamb 54 spaced away from the first sash jamb 52 and is oriented substantially parallel to the first sash jamb 52, and is connected to the other end of the first sash header 48 and the other end of the first sash sill 50. The first insulated glass unit 18 is received in the first opening 46 defined by the first sash header 48, the first sash sill 50, the first sash jamb 52, and the second sash jamb 54. The first insulated glass unit's 18 construction is conventional, such as two panes of spaced-apart glass, two panes of spaced-apart safety glass, or two or three panes of spaced-apart coated glass, with any of the panes connected together by a peripheral seal to form an insulation air space between the panes of glass. Single panes of insulated glass may also be used. As shown in FIG. 2, weather stripping 56 may be positioned along peripheral edges of the first sash 14. One half of a conventional window locking device 58A may also be provided on the first sash sill 50.

Referring again to FIGS. 2 and 3, the second sash 16 is similar to the first sash 14. The second sash 16 defines a second opening 60 formed by a second sash header 62, a second sash sill 64 spaced away from the second sash header 62 and oriented substantially parallel to the second sash header 62, a third sash jamb 66 connected to one end of the second sash header 62 and one end of the second sash sill 64, and a fourth sash jamb 68 spaced away from the third sash jamb 66 and is oriented substantially parallel to the third sash jamb 66 and is connected to the other end of the second sash header 62 and the other end of the second sash sill 64. The second insulated glass unit 20 is received in the second opening 60 defined by the second sash header 62, the second sash sill 64, the third sash jamb 66, and the fourth sash jamb 66. The second insulated glass unit 20 is also conventional. Weather stripping 56 may be positioned along peripheral edges of the second sash 16. Another half of a conventional locking device 58B may also be provided on the second sash header 62.

Figure 4A:
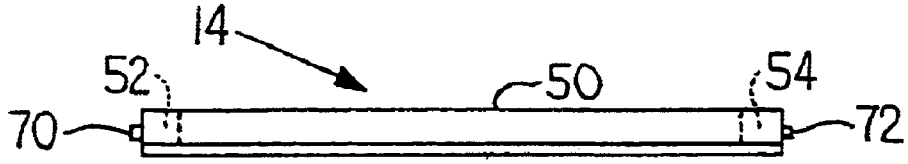
FIG. 4A is a bottom view of a first sash.
Figure 4B:
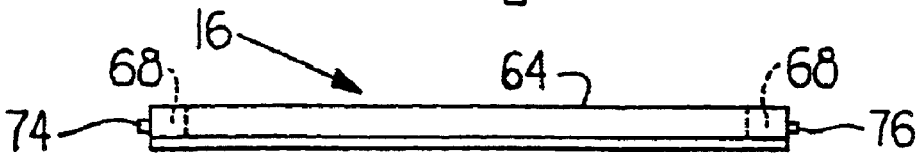
FIG. 4B is a bottom view of a second sash.

As shown in FIG. 4A, a first sash retaining arm 70 is positioned at an intersection of the first sash jamb 52 and the first sash sill 50. A second sash retaining arm 72 is positioned at an intersection of the second sash jamb 54 and the second sash sill 64. Likewise, as shown in FIG. 4B, a third sash retaining arm 74 is positioned at an intersection of the third sash jamb 68 and the second sash sill 64. A fourth sash retaining arm 76 is positioned at an intersection of the fourth sash jamb 68 and the second sash sill 64.

Figure 5:
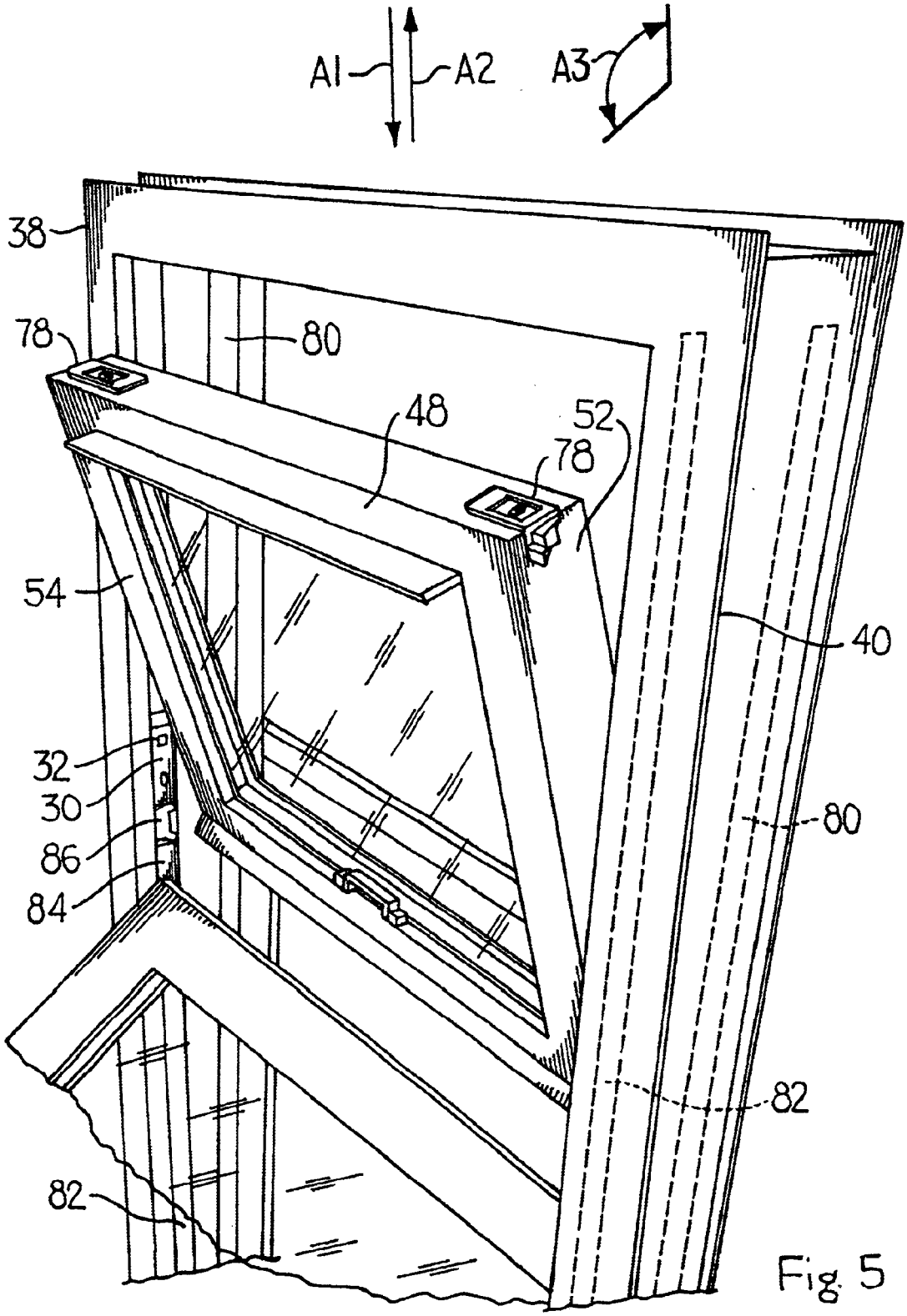
FIG. 5 is a perspective view of the replacement window shown in FIGS. 1 and 3, with the first sash shown in FIG. 4A installed in the replacement window and pivoted away from a window frame of the replacement window and the second sash shown in FIG. 4B installed in the replacement window and pivoted away from the window frame of the replacement window.
Figure 6:
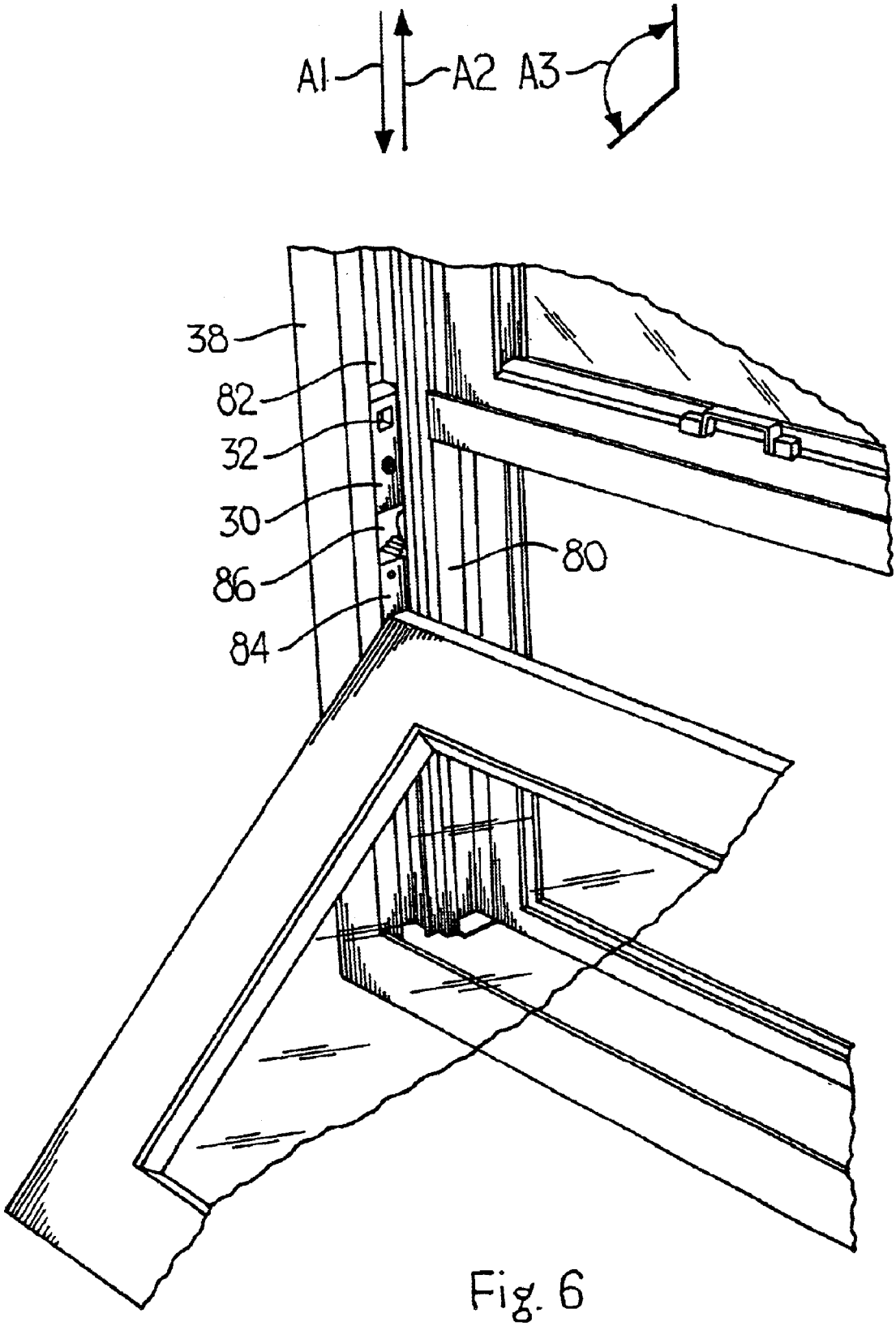
FIG. 6 is a perspective view of the second sash shown in FIG. 4B pivoted away from a window frame of the replacement window.
Figure 7:
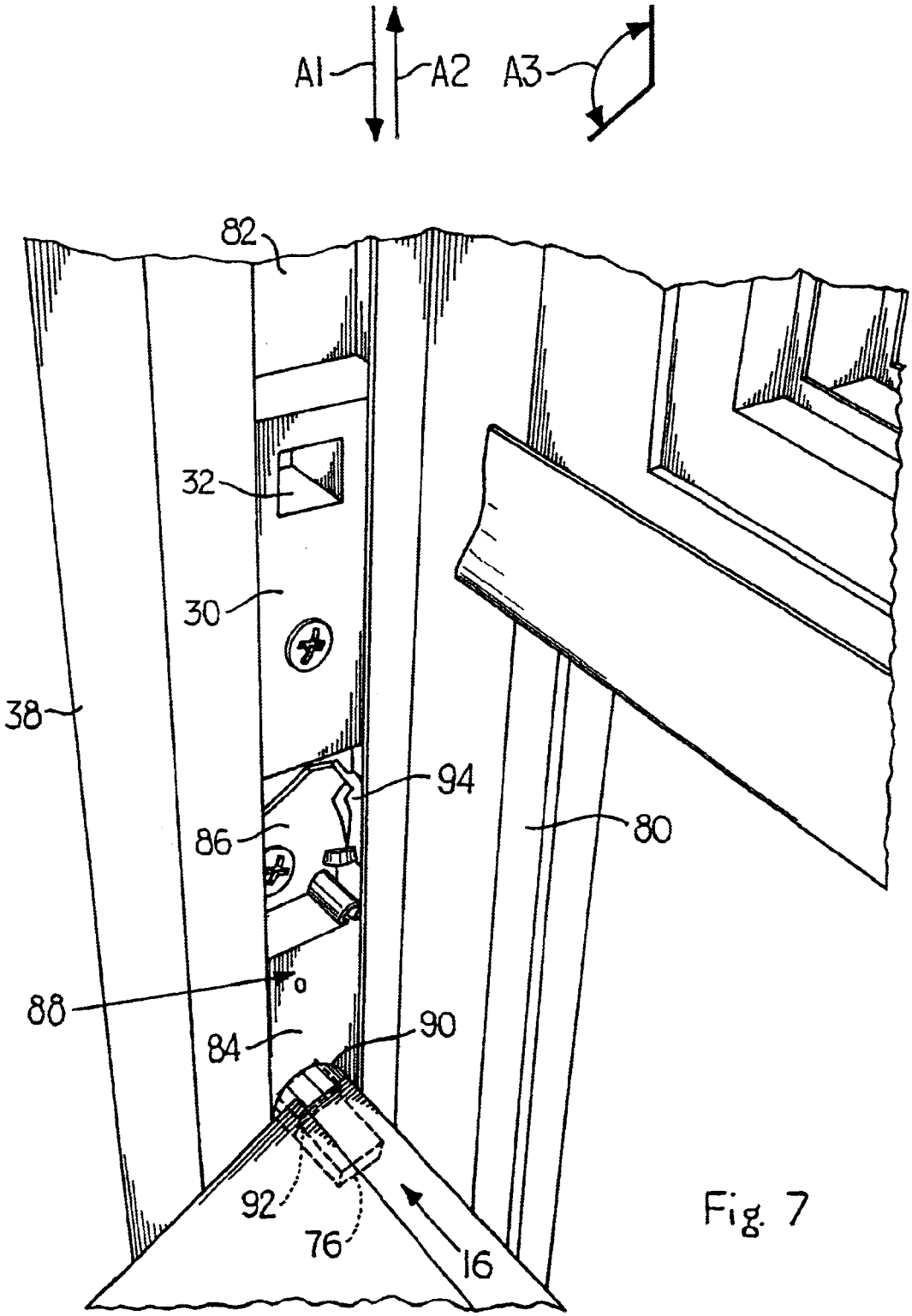
FIG. 7 is a magnified perspective view of the window frame shown in FIG. 6.

As shown in FIG. 5, the first sash header 48 has one or more conventional spring clips 78 which retract and protrude from intersections formed by the first sash header 48 and the first sash jamb 52 and the first sash header 48 and the second sash jamb 54. The first and second frame jambs 38, 40 each define a first balance track 80 and a second balance track 82. As shown in FIGS. 5–7, included in the second balance track 82 of the first frame jamb 38 and in the second balance track 82 the second frame jamb 40 is the jamb retainer clip 30, a shoe balance 84, and a balance anchor 86. The jamb retainer clip 30, also shown in FIG. 1, is preferably made from polycarbonate, commercially available under the BAKELITE tradename, but may also be made from metal, wood, vinyl or any other suitable material.

The shoe balance 84 is preferably a pretensioned balance known to those skilled in the art. In general, as shown in FIG. 7, the shoe balance 84 includes a balance housing 88, a wheel 90 that is rotatable with respect to the balance housing 88 and defines a sash retaining arm orifice 92, and a pretensioned, coiled strip 94 of metal or other suitable material that is encased in the balance housing 88. One end of the coiled strip 94 is attached to the balance anchor 86 that is rigidly attached in the second balance track 82 defined by the first frame jamb 38. The same is also true for a shoe balance 84 positioned in the second balance track 82 defined by the second frame jamb 40, a shoe balance 84 positioned in the first balance track 80 of the first frame jamb 38, and a shoe balance 84 positioned in the first balance track 80 of the second frame jamb 40.

As a shoe balance 84 slides in its corresponding balance track 80, 82, indicated by arrow A1, the pretensioned, coiled strip 94 unrolls from the balance housing 88. Accordingly, as the balance housing 88 is moved further away from its corresponding balance anchor 86, the length of the pretensioned, coiled strip 94 that extends from the balance housing 88 increases. Conversely, if the balance housing 88 is moved toward its corresponding balance anchor 86, indicated by arrow A2, the length of the pretensioned, coiled strip 94 that extends from the balance housing 88 decreases. The tension provided by the coiled strip 94 creates a restoring force that is calculated to approximately counterbalance the combined approximate weight of a sash and a double pane of glass.

As shown in FIGS. 4A, 4B, and 7, the sash retaining arms 70, 72, 74, 76 positioned on the first and second sashes 14, 16 are received in a corresponding sash retaining arm orifice 92 defined by wheel 90 of a corresponding shoe balance 84. For example, FIG. 7 shows that the second sash 16 is installed in the window frame 12 by inserting the fourth sash retaining arm 76 in the sash retaining arm orifice 92 defined by the wheel 90 of the shoe balance 84 positioned in the second balance track 82 of the first frame jamb 38. Similarly, but not shown in FIG. 7, the third sash retaining arm 74 is inserted into the sash retaining arm orifice 92 defined by the wheel 90 of the shoe balance 84 positioned in the second balance track 82 defined by the second frame jamb 40 of the window frame 12. As shown in FIGS. 5–7, when the first and second sashes 14, 16 are installed in the window frame 12 via the shoe balance 84, the first and second sashes 14, 16 can be moved within the confines of the window frame 12, indicated by arrows A1 and A2 or pivoted in a direction away from the window frame 12 and opposite to the framed screen 44, if installed, as shown by arrows A3.

Figure 9:
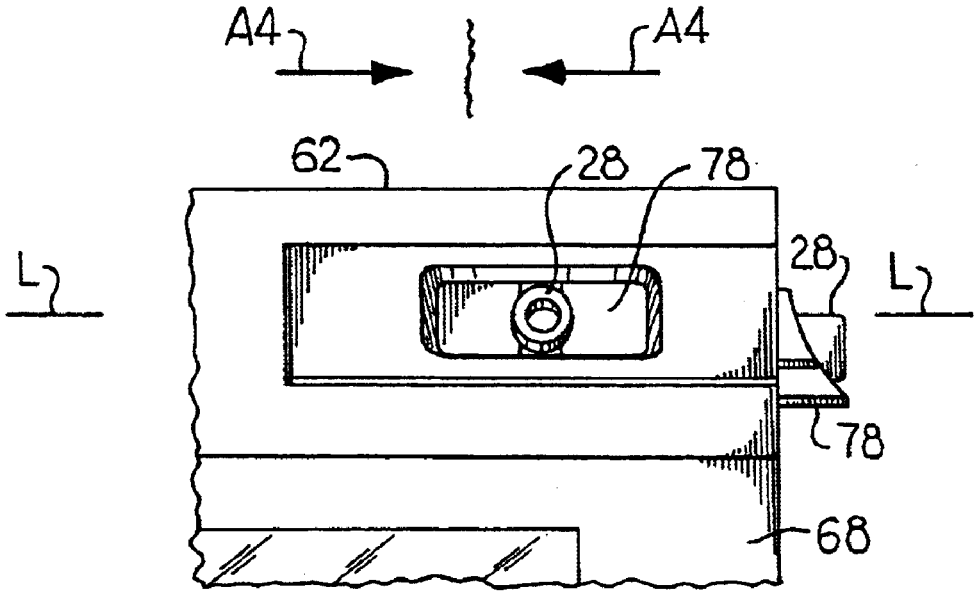
FIG. 9 is a top perspective view of the second sash header shown in FIG. 8.
Figure 8:
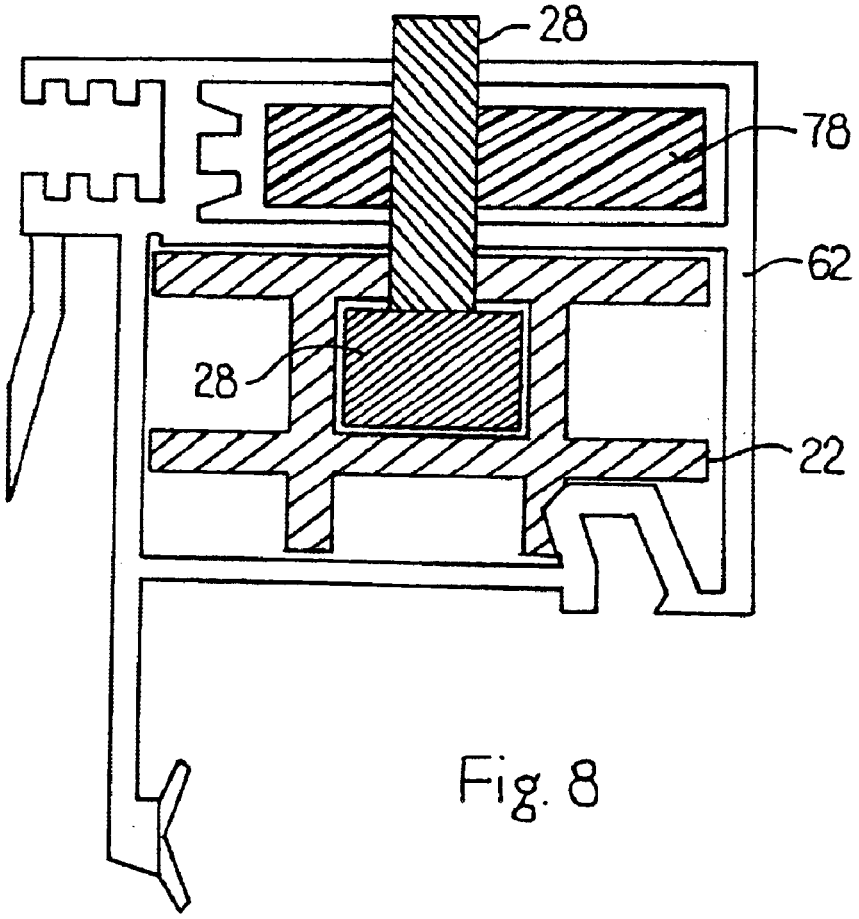
FIG. 8 is a cross-sectional end view of a second sash header according to the present invention.

Referring generally to FIG. 8, the reinforcement member 22 is preferably encased in the second sash header 62. The reinforcement member 22 is preferably a hollow, double I-beam made from metal or other suitable material. The reinforcement member 22 preferably extends along an entire length of the second sash header 62, but may also be segmented into two sections. A spring clip 78 is received in a cavity defined by the second sash header 62, as is convention, and the pin lever 28 is connected to the spring clip 78 and to the reinforcement pin 28. As shown in FIG. 9, the reinforcement pin 24 and the spring clip 78 are oriented coincident with an imaginary longitudinal axis L extending along the second sash header 62, and positioned at an intersection of the second sash header 62 and the fourth sash jamb 68. Both the reinforcement pin 24 and the spring clip 78 arc biased by the spring 26 shown in phantom in FIG. 1. Another reinforcement pin 24 and another spring clip 78, each also biased by a spring 26, may also be oriented coincident with the imaginary longitudinal axis L extending along the second sash header 62 and positioned at an intersection of the second sash header 62 and the third sash jamb 66.

When the first and second sashes 14, 16 are in a closed position, as shown in FIGS. 1–3, forces acting on the window panes 18, 20 and the sashes 14, 16 are transferred along the reinforced second sash 16 via the reinforcement member 22, through the reinforcement pins 24, through the jamb retainer clips 30, and into the first and second frame jambs 38, 40 of the window frame 12. It has been found that this arrangement provides strength to the replacement window 10.

To clean the first and second insulated glass units 18, 20, as shown generally in FIG. 9, the second sash 16 is pivoted by retracting the spring clip 78 and reinforcement pin 28 combinations into the second sash header 62, as indicated by opposing arrows A4. The retraction moves the opposed reinforcement pins 24 from their corresponding reinforcement pin orifices 32, while simultaneously allowing the spring clips 78 to clear the second balance track 82. The second sash 16 may then be pivoted in the direction indicated by arrows A3. The first sash 14 can then be moved in the direction indicated by arrow A1 and then pivoted in the direction of arrow A3 after the spring clips 78 are retracted into the first sash header 48.

Three double-hung windows, made as described above with dimensions of 44 inches wide by 60 inches high with a 4 inch deep frame (upper vent 39 3/16 inches wide by 28 3/4 inches high and lower vent 40 3/16 inches wide by 29 3/4 inches high) were tested according to Dade County (Florida) Protocols PA 201 (the Missile Impact Test) and PA 203 (Cyclic Wind Pressure Test).

Figure 10C:
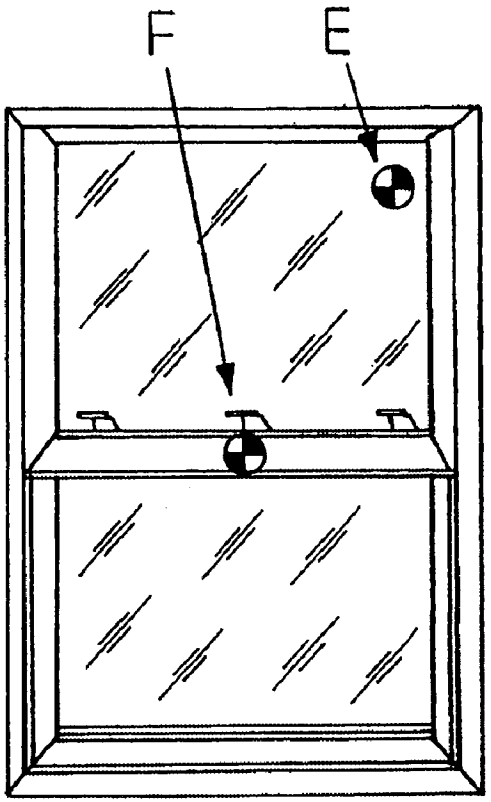
FIG. 10 is a front elevation view of three windows showing impact locations.
Figure 10B:
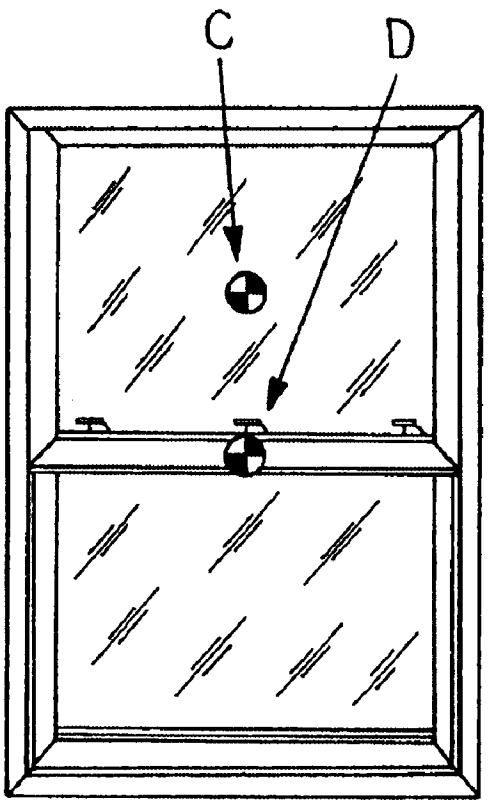
Figure 10A:
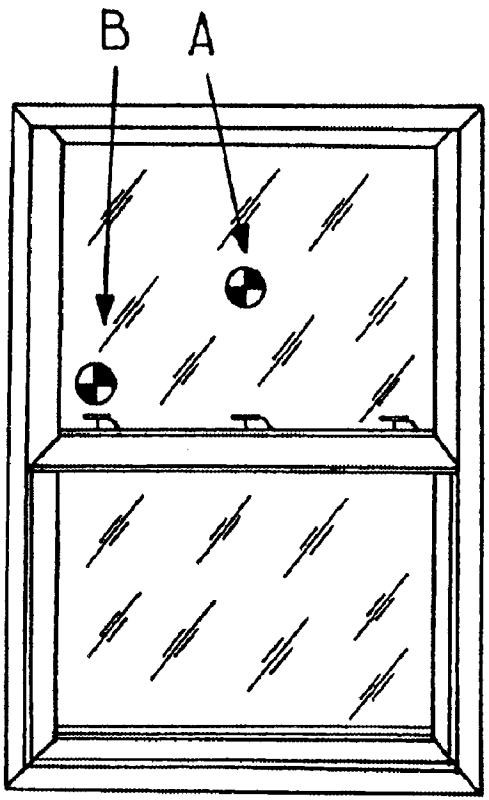

In the Missile Impact Test, a 9 lb., 2 inch×4 inch×96 inch #2 Southern Yellow Pine stud was propelled at the three test windows at a velocity of 50 ft./sec. (34 mph). The location of the test impact points for each window is shown in FIG. 10 as A and B for window Example 1, shown C and D for window Example 2, and shown as E and F for window, Example 3. In each instance, no penetration of the stud was observed.

Next, each of the windows was subjected to the cyclic wind pressure test. This test is conducted after the Missile Impact Test has been completed. By simulating the forces applied to a window by repeated severe wind gusts, this test exposes possible weaknesses in the window assembly created by the missile impacts. In this test, the window assembly is installed in a chamber, and pressures are applied for only a few seconds and repeated several hundred times. The deflection of the components and the anchorage system are examined. The three window examples were exposed to the following conditions:

| Number of Pressure Cycles | Pressure (fps) | Duration (seconds) |
|---|---|---|
| Positive Pressure Cycles | | |
| 3500 | +29 | 1 |
| 300 | +35 | 1 |
| 600 | +47 | 1 |
| 100 | +58 | 1 |
| Negative Pressure Cycles | | |
| 50 | −67 | 2 |
| 1050 | −54 | 1 |
| 50 | −41 | 2 |
| 3350 | −34 | 1 |

The three sample windows were structurally intact, operable, and all parts were securely in place at the conclusion of the tests. These results indicate that the replacement window of the present invention meets the strict building code requirements of Dade County (Florida) PA 201 and PA 203, and other such building codes requiring rigorous performance standards in hurricane prone areas.

As is described above, the present invention transmits forces applied to the windows and sashes of a replacement window, such as a double-hung replacement window, through a reinforced sash, reinforcement pins, and jamb retainer clips. The force is then more evenly distributed through the frame jambs. This allows a replacement window according to the present invention to withstand violent replacements.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents hereof.

We claim:

1. A replacement window comprising:

a window frame having a window header, a window sill, a first frame jamb, and a second frame jamb, wherein the first frame jamb and the second frame jamb each connect the window header to the window frame and the window header, the window sill, and the first frame jamb and the second frame jamb define a window frame opening;

a sash having a reinforced sash header, the sash movably positioned in the window frame opening;

a reinforcement pin positioned adjacent to the reinforced first sash header of the sash; and a jamb retainer clip positioned adjacent to the first frame jamb, the jamb retainer clip defining a reinforcement pin orifice, wherein the reinforcement pin orifice receives the reinforcement pin, a first balance track and a second balance track each defined by the first frame jamb and the second frame jamb, the jamb retainer clip being positioned in the second balance track of the first frame jamb, a shoe balance positioned in the second balance track, defined by the first frame jamb and the second frame jamb, wherein the shoe balance comprises a balance housing, a wheel which defines a sash retaining arm orifice and is movable with respect to the balance housing, and a pretensioned, coiled strip enclosed in the balance housing.

2. The replacement window as claimed in claim 1, wherein the sash further comprises:

a sash sill spaced away from the reinforced sash header and oriented substantially parallel to the reinforced sash header; and a pair of sash jambs each connecting the reinforced sash header to the sash sill, wherein the pair of sash jambs are spaced away from one another and oriented substantially parallel to one another, and the reinforced sash header, the pair of sash jambs, and the sash sill define an opening.

3. The replacement window as claimed in claim 2, further comprising a insulated glass unit positioned in the opening.

4. The replacement window as claimed in claim 1, wherein the sash further comprises:

a sash sill spaced away from the reinforced sash header and oriented substantially parallel to the reinforced sash header; and a pair of sash jambs each connecting the reinforced sash header to the sash sill, wherein the pair of sash jambs are spaced away from one another and oriented substantially parallel to one another, and the reinforced sash header, the pair of sash jambs, and the sash sill define an opening; and a pair of sash retaining arms, wherein one of the pair of sash retaining arms is positioned at an intersection of the first sash jamb and the sash sill and another of the sash retaining arms is positioned at an intersection of the second sash jamb and the sash sill.

5. The replacement window as claimed in claim 1, wherein the window frame is made from a material selected from the group consisting of vinyl, wood, metal, fiberglass, or other suitable material.

6. The replacement window as claimed in claim 1, wherein the jamb retainer clip is made from a material selected from the group consisting of vinyl, wood, metal, or any other suitable material.

7. A replacement window comprising:

a window frame having a window header, a window sill, a first frame jamb, and a second frame jamb, wherein the first frame jamb and the second frame jamb each connect the window header to the window frame and the window header, the window sill, and the first frame jamb and the second frame jamb define a window frame opening;

a first sash positioned in the window frame opening, the first sash comprising:

a first sash header, a first sash sill spaced away from the first sash header and oriented substantially parallel to the first sash header, a first sash jamb connected to one end of the first sash header and one end of the first sash sill, and a second sash jamb spaced away from the first sash jamb is oriented substantially parallel to the first sash jamb and is connected to another end of the first sash header and another end of the first sash sill, wherein the first sash header, the first sash sill, the first sash jamb, and the second sash jamb define a first opening;

a second sash movably positioned in the window frame opening, the second sash comprising:

a second sash header, a second sash sill spaced away from the second sash header and oriented substantially parallel to the second sash header, a third sash jamb connected to one end of the second sash header and one end of the second sash sill, and a fourth sash jamb spaced away from the third sash jamb and is oriented substantially parallel to the third sash jamb and is connected to another end of the second sash header and another end of the second sash sill, wherein the second sash header, the second sash sill, the third sash jamb, and the fourth sash jamb define a second opening;

a reinforcement member, having a hollow, double I-beam shape, encased in the second sash header;

a reinforcement pin positioned adjacent to the second sash header of the second sash; and one jamb retainer clip positioned adjacent to the first frame jamb and another jamb retainer clip positioned adjacent to the second frame jamb, wherein each of the jamb retainer clips defines a reinforcement pin orifice which receives a corresponding reinforcement pin.

8. The replacement window as claimed in claim 7, wherein the first frame jamb and the second frame jamb each define a first balance track and a second balance track.

9. The replacement window as claimed in claim 8, wherein the one jamb retainer clip is positioned in the second balance track of the first frame jamb and the other jamb retainer clip is positioned in the second balance track of the second frame jamb.

10. The replacement window as claimed in claim 8, further comprising a plurality of shoe balances, with one of the plurality of shoe balances positioned in the first balance track defined by the first frame jamb, another one of the plurality of shoe balances positioned in the first balance track defined by the second frame jamb, another one of the plurality of shoe balances positioned in the second balance track defined by the first frame jamb, and another of the plurality of shoe balances positioned in the second balance track defined by the second frame jamb.

11. The replacement window as claimed in claimed 7, further comprising a first insulated glass unit positioned in the first opening of the first sash.

12. The replacement window as claimed in claim 7, further comprising a second insulated glass unit positioned in the second opening of the second sash.

13. The replacement window as claimed in claim 7, wherein the reinforcement member extends along an entire length of the second sash header.

14. The replacement window as claimed in claim 7, wherein the window frame is made from a material selected from the group consisting of vinyl, wood, metal, or any other suitable material.

15. The replacement window as claimed in claim 7, wherein the jamb retainer clip is made from a material selected from the group consisting of vinyl, wood, metal, or any other suitable material.

16. The replacement window as claimed in claim 7, wherein the reinforcement member is made from a material selected from vinyl, wood, metal, or any other suitable material.

* * * * *